United States Patent [19]

De Nora et al.

[11] 4,130,468

[45] Dec. 19, 1978

[54] METHOD OF OPERATION OF AN ELECTROLYSIS CELL WITH VERTICAL ANODES AND CATHODES

[75] Inventors: Oronzio De Nora, Milan, Italy; Vittorio De Nora, Nassau, The Bahamas

[73] Assignee: Oronzio de Nora Impianti Elettrochimici S.p.A., Milan, Italy

[21] Appl. No.: 860,679

[22] Filed: Dec. 15, 1977

Related U.S. Application Data

[62] Division of Ser. No. 655,493, Feb. 5, 1976, Pat. No. 4,073,715.

[30] Foreign Application Priority Data

Nov. 28, 1975 [IT] Italy ..... 29782 A/75

[51] Int. Cl.[2] ..... C25B 1/34; C25B 9/00; C25B 11/03

[52] U.S. Cl. ..... 204/98; 204/256

[58] Field of Search ..... 204/98, 255–258, 204/263, 264, 269

[56] References Cited

U.S. PATENT DOCUMENTS

| | | | |
|---|---|---|---|
| 3,342,717 | 9/1967 | Leduc | 204/265 |
| 3,616,442 | 10/1971 | Cheng et al. | 204/257 |
| 3,809,630 | 5/1974 | De Nora et al. | 204/98 |
| 3,855,104 | 12/1974 | Messner | 204/129 |
| 3,928,150 | 12/1975 | Rahn et al. | 204/98 |
| 3,956,097 | 5/1976 | De Nora et al. | 204/252 |

*Primary Examiner*—F.C. Edmundson

*Attorney, Agent, or Firm*—Hammond & Littell

[57] ABSTRACT

Describes an electrolysis cell and method of operation in which metal anodes (preferably titanium) provided with an electrically conducting electrocatalytic coating, in an anode compartment, face metal cathodes (preferably diaphragm covered) in a cathode compartment, in which the anodes are spaced from an imperforate valve metal separating partition by a separating wall behind which the anolyte can recirculate downward. The anodic gases rising in the anode compartment discharge into a brine box above the anode compartment near the center thereof and the anolyte recirculates downward near at least one end of the anode compartment, and a method of operation which provides circulation from front to back of the anode compartment and from center to the sides of the anode compartment.

10 Claims, 21 Drawing Figures

8b
5k
8
8
5j
5j 5e
5h
5g
5i
5i 8b
8a
5
8b
8a 5h
5i
C
5g 5e
5h
5g
5i 5b
8
8a
5
8
5
8a
5b

FIG. 18
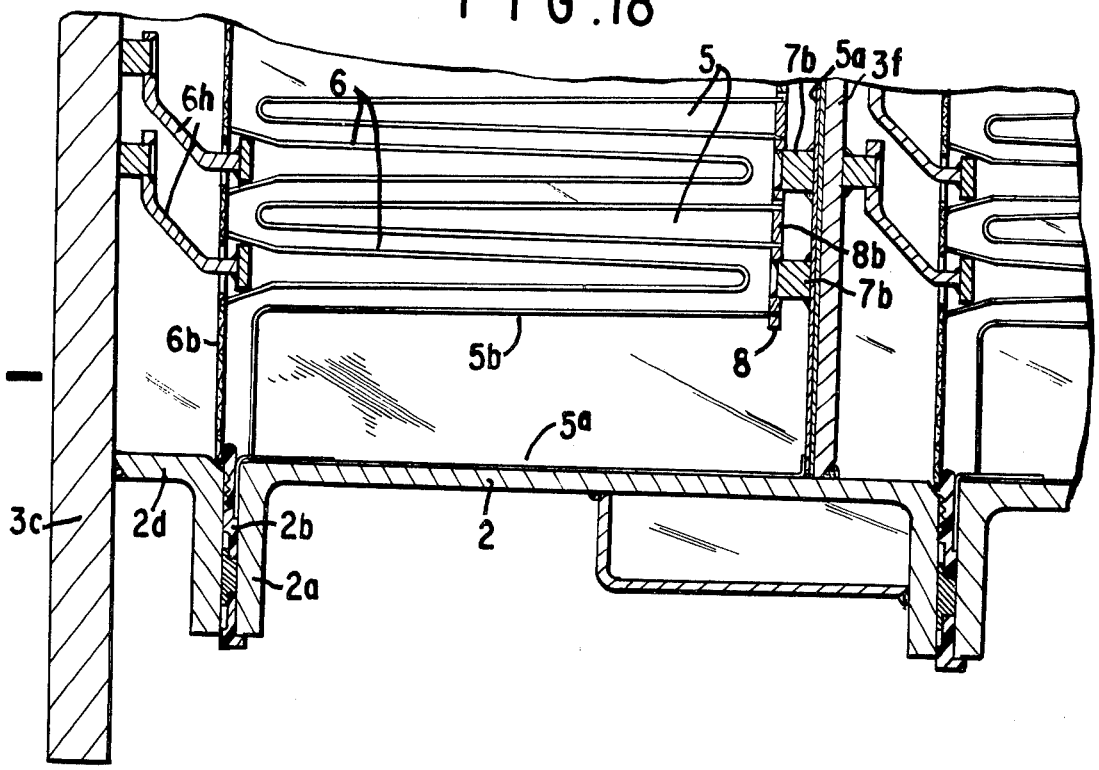
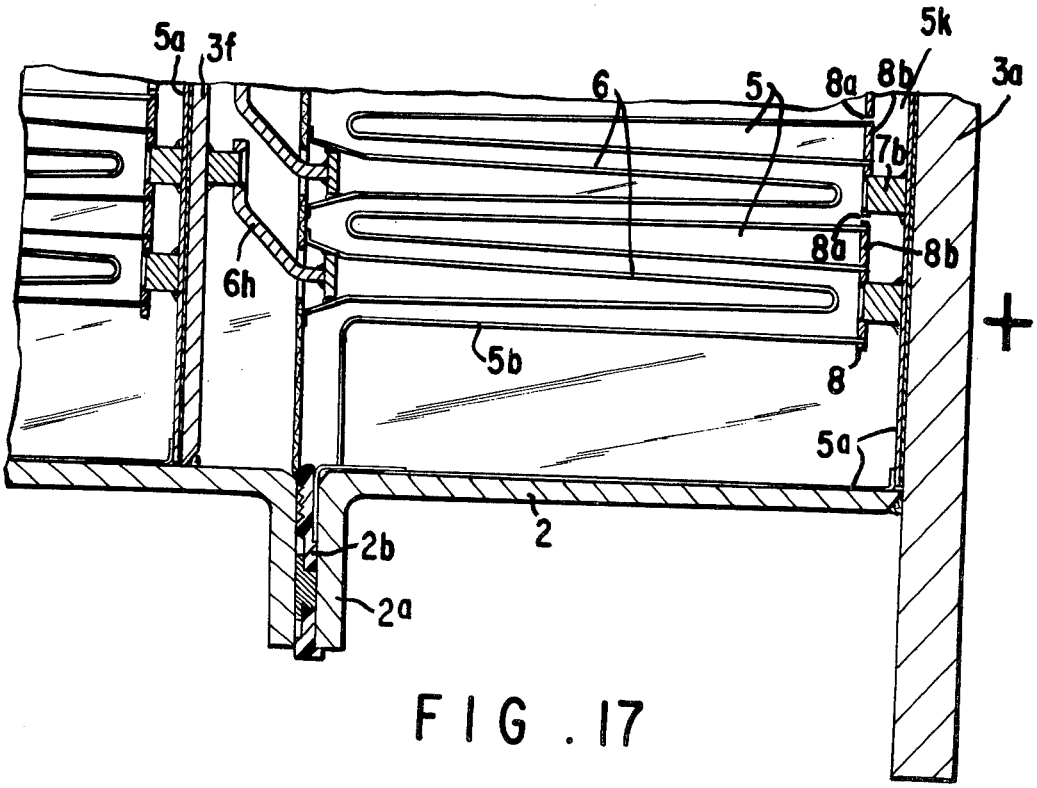
FIG. 17

METHOD OF OPERATION OF AN ELECTROLYSIS CELL WITH VERTICAL ANODES AND CATHODES

This is a division of Ser. No. 655,493, filed Feb. 5, 1976, now U.S. Pat. No. 4,073,715.

This invention relates to electrolysis cells and methods of electrolysis as used, for example, for the electrolysis of alkali metal halides such as lithium, sodium and potassium chlorides, bromides and iodides and, more generally, for the electrolysis of halogenides and for the electrolysis of other salts which undergo electrolytic decomposition under electrolysis conditions, for the production of chlorates or perchlorates, for the electrolysis of hydrochloric acid to produce hydrogen and chlorine, for the electrolysis of water to produce hydrogen and oxygen, for the electrolysis of sodium and potassium sulfate to produce caustic soda or caustic potash and sulfuric acid, for the electro-osmosis and electrodialysis, for organic oxidation and reduction reactions, and for other processes which may be carried out by electrolysis reactions.

The cell and method will be described for the electrolysis of sodium chloride to produce chlorine and caustic soda, but this is only for the purpose of illustrating the invention. It will also be described as a multiple unit bipolar cell, but it will be understood that it may be operated as individual units, either separately or connected together by intermediate connections.

One of the objects of this invention is to provide new types of electrodes and electrolysis cells in which anodic and cathodic reactions may be carried out more efficiently than in prior electrolysis cells, which are easier and cheaper to construct and maintain in service and which have a longer life between dismantlings for diaphragm replacement and other repairs than prior electrolysis cells.

Another object is to provide electrolysis cells which have a greater recirculation of the electrolyte within the anolyte compartment than prior electrolysis cells.

Another object is to provide an electrolysis cell and process in which the electrolyte circulation through the cell provides more uniform electrolyte composition throughout the cells than prior electrolysis cells and prolongs the normal life of the diaphragms.

Another object is to provide an electrolysis cell in which diaphragm material may be added to the electrolyte and circulated through the electrolysis cell to deposit additional diaphragm material on the diaphragm as needed and to provide means to make such additions.

Another object is to provide an electrolysis cell and process in which the electrolyte is circulated upwardly by the anodic gases in the interelectrodic gap between the anodes and cathodes and within the hollow fingers or waves of the anodes and downwardly behind the anodes, and is also recirculated upwardly toward the center and downwardly toward at least one side of the cell, to thereby provide circulation of the electrolyte from front to back and from the center to the sides of each cell unit.

Another object is to provide an electrolysis cell and process in which the anodic gases have a larger space in which to escape from the electrolysis gap and from the cell with a minimum of obstruction against their escapes, to thereby provide greater circulation of the electrolyte within the cell.

Another object is to provide imperforate metal separating partitions between the cell units of a bipolar cell in which the separating partitions on the anodic side are non-corrosive to anodic conditions and on the cathodic side are non-corrosive to cathodic conditions.

Another object is to provide an electrolysis cell and method in which the anodes and cathodes may be individually assembled on the anode and cathode supports.

Various other objects and advantages of this invention will appear as this description proceeds.

Referring now to the drawings, which show one embodiment of the invention for the purpose of illustration:

Figure 8:
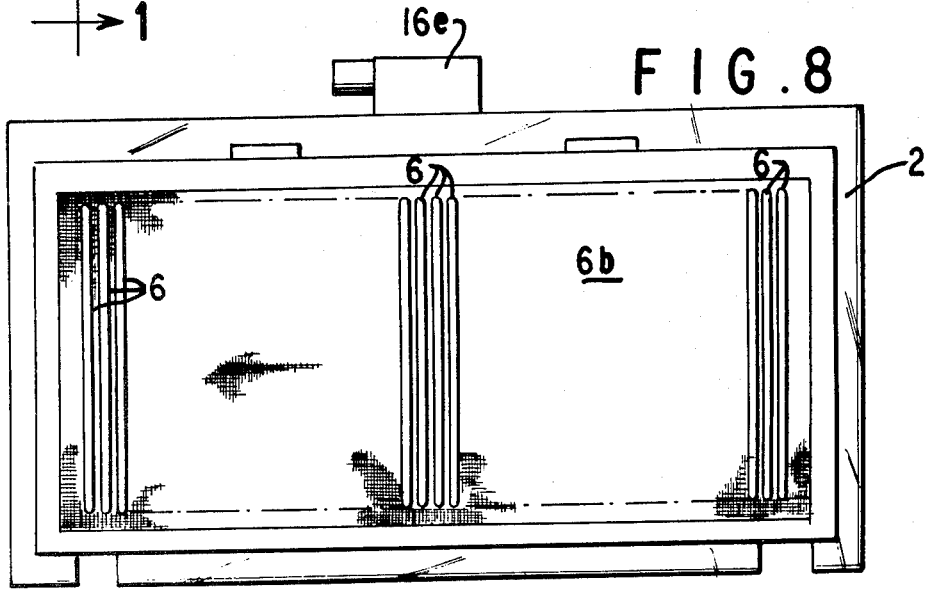
Figure 5:
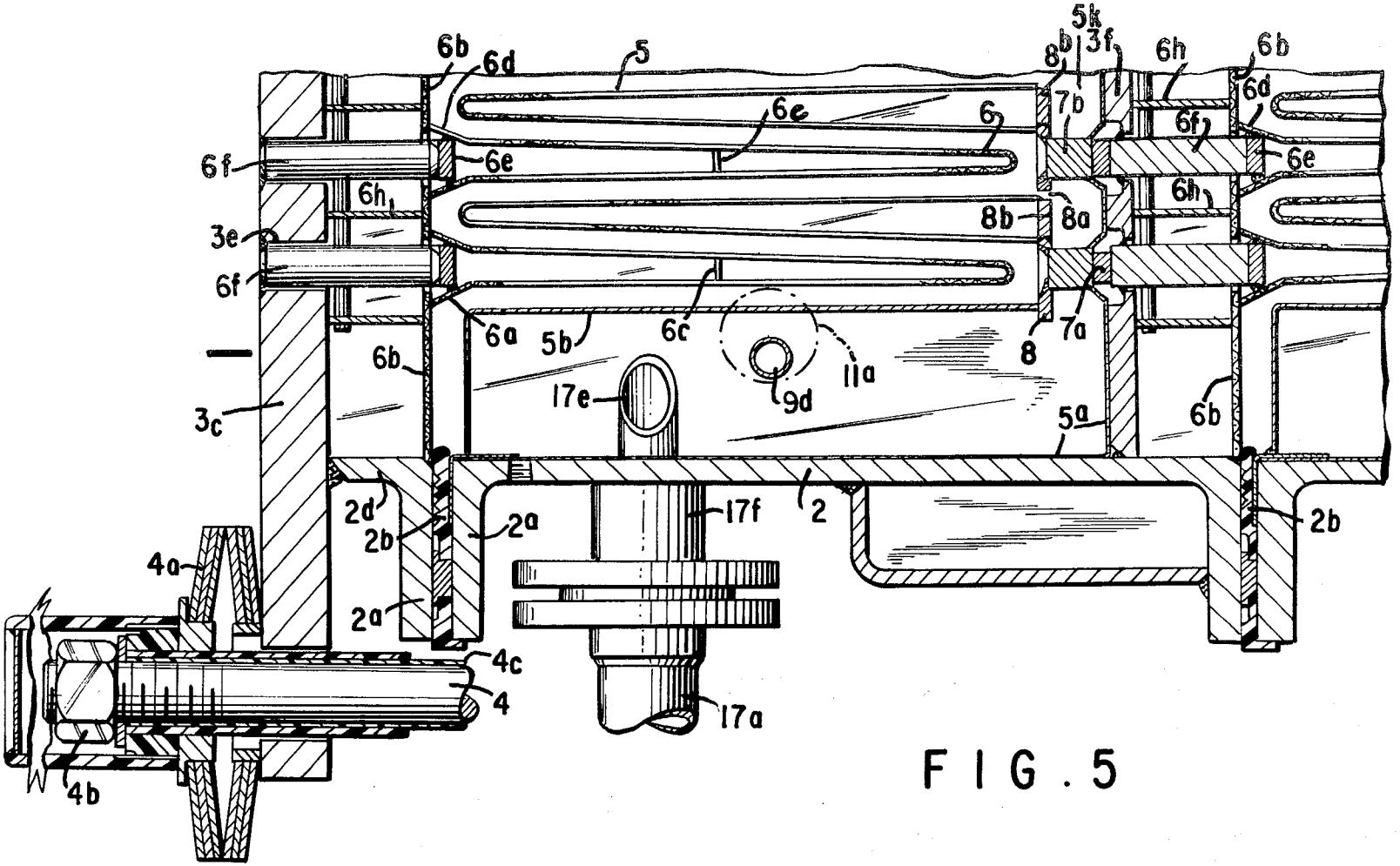
FIG. 5 is a cross-sectional plan view of a portion of a bipolar cell unit at the cathode end of the cell, showing one intermediate separating partition.
Figure 5A:
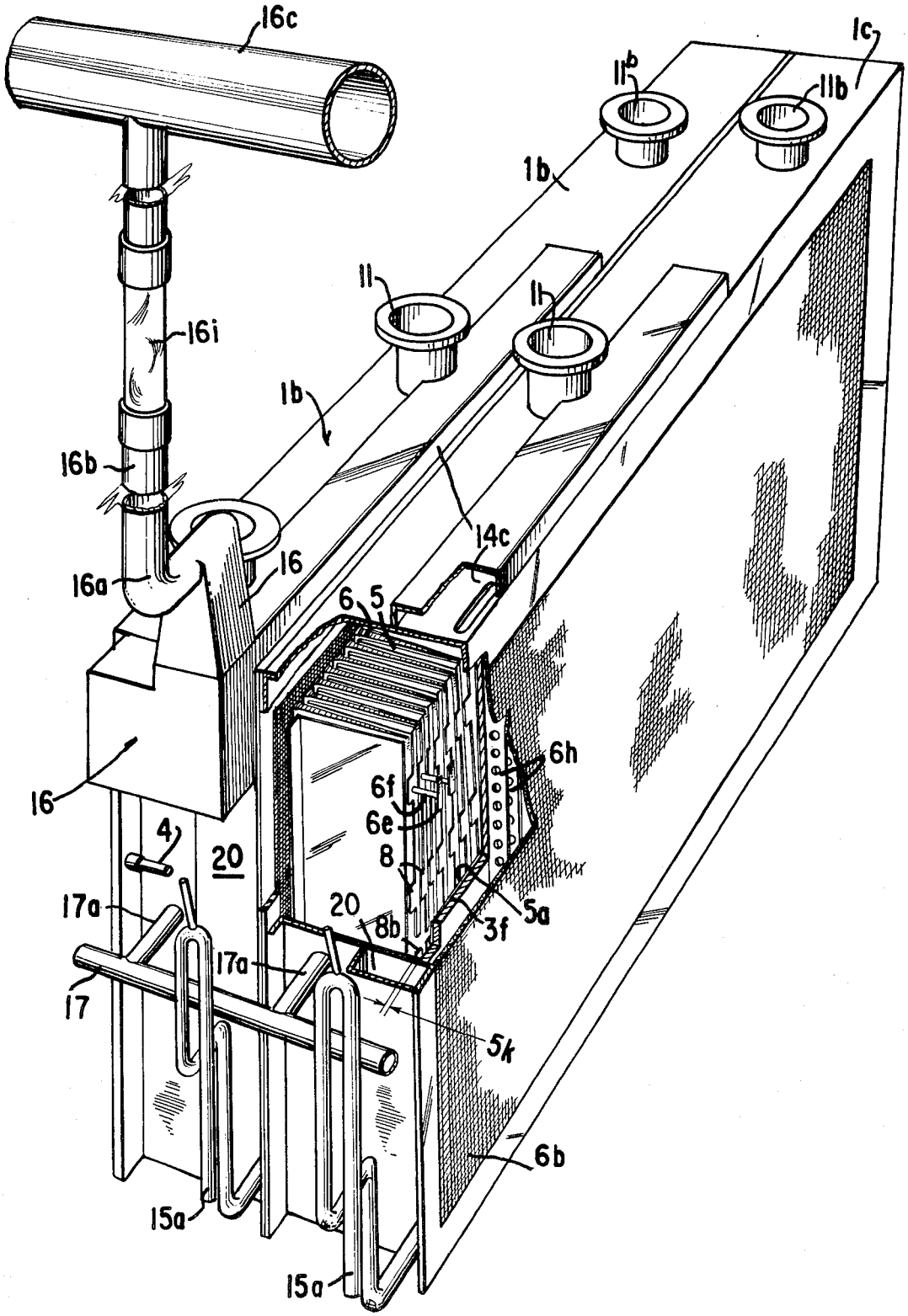
Figure 6:
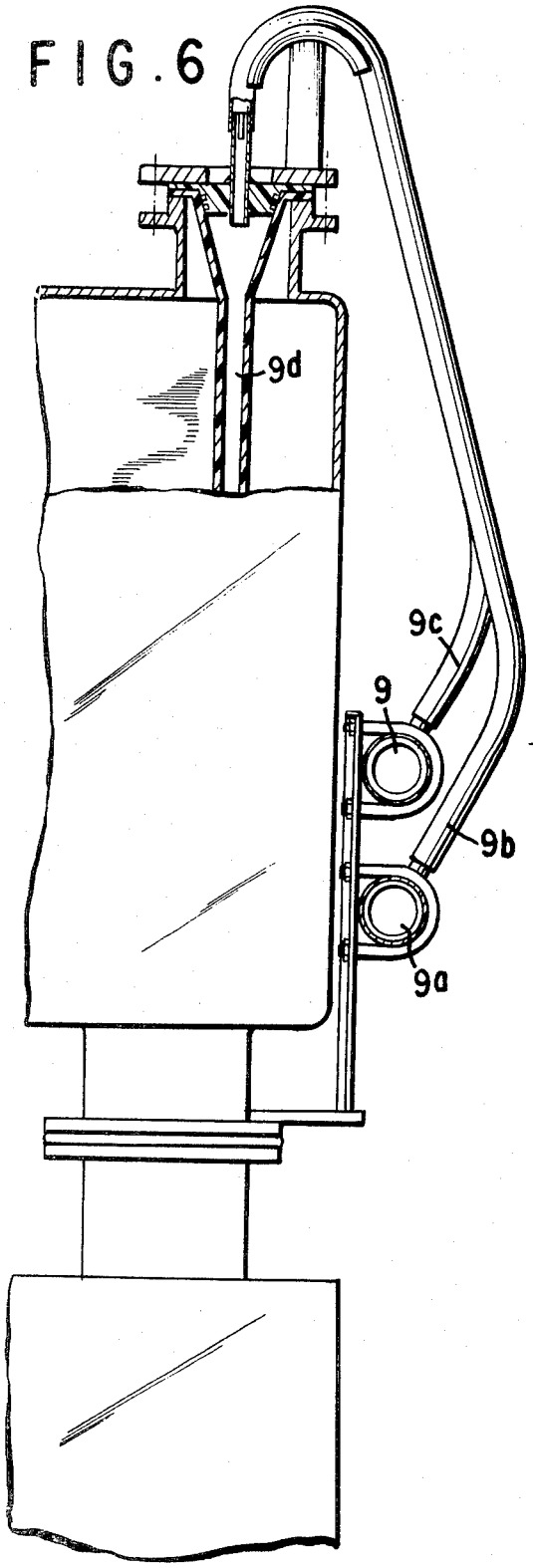
Figure 7:
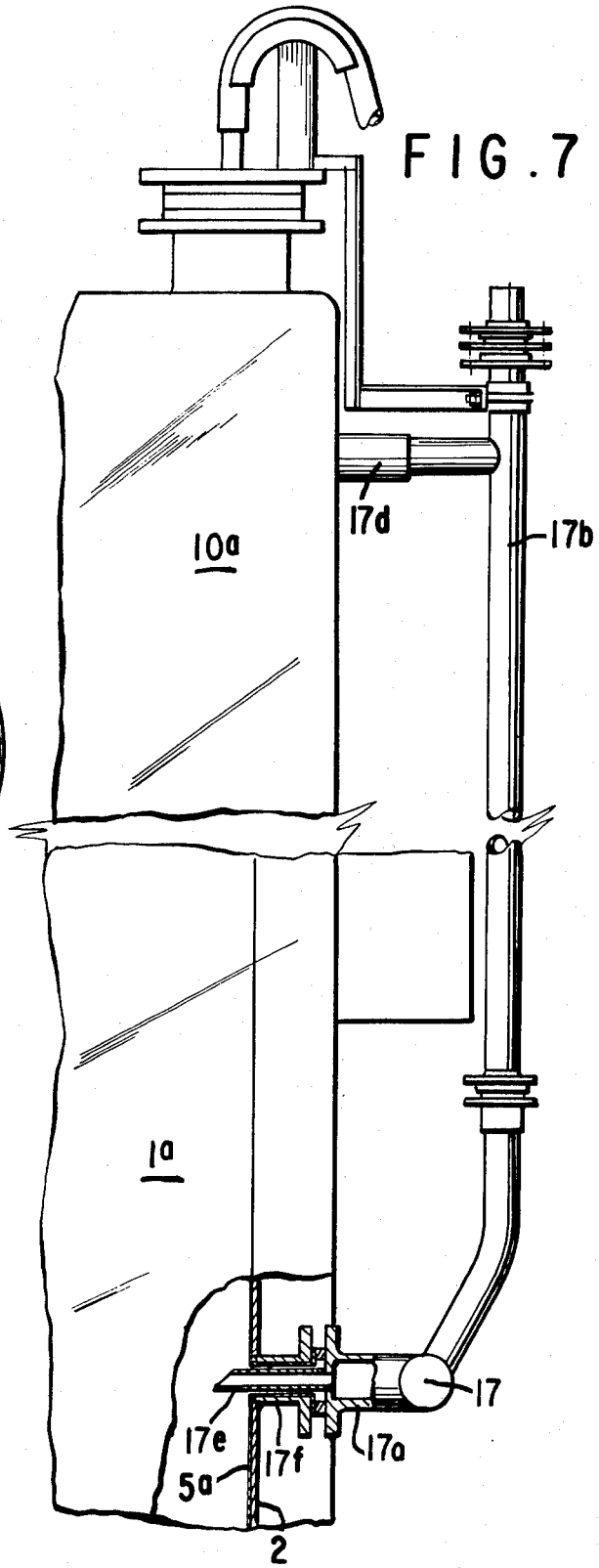
Figure 9:
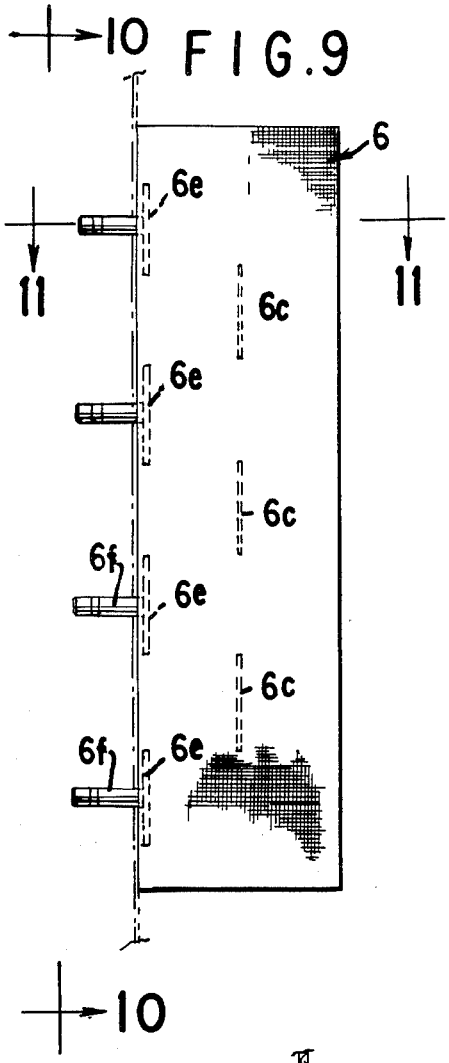
Figure 10:
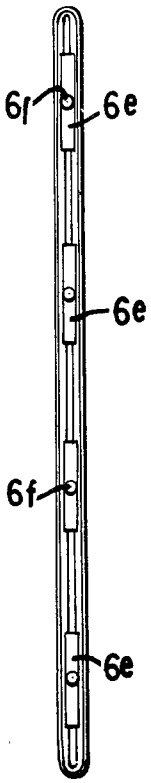
Figure 12:
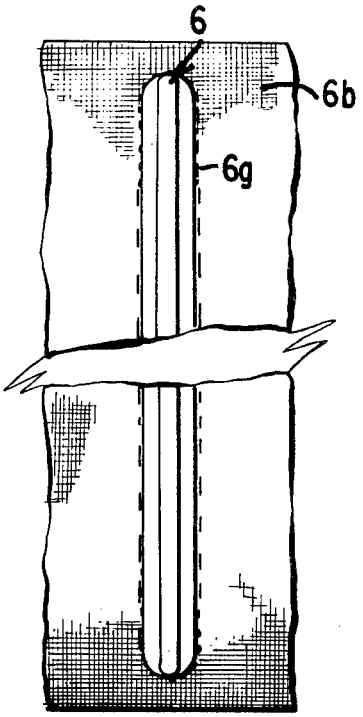
Figure 11:
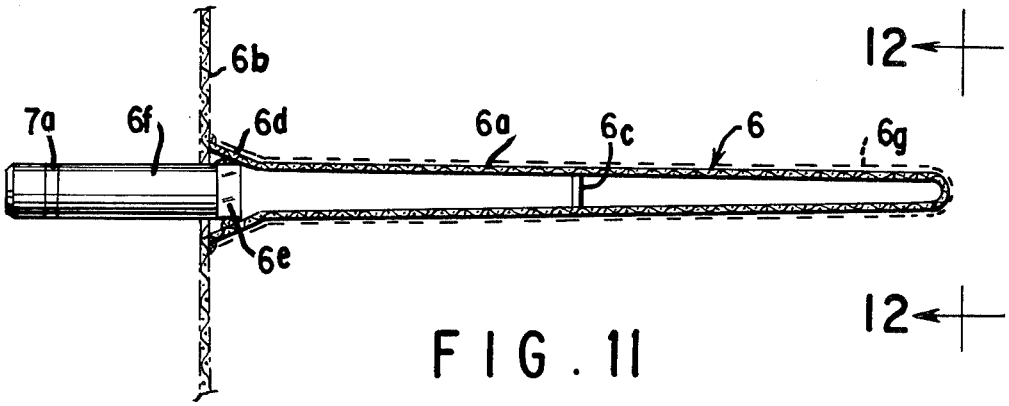
Figures 13, 13A, 14, 14A, 15, 16:
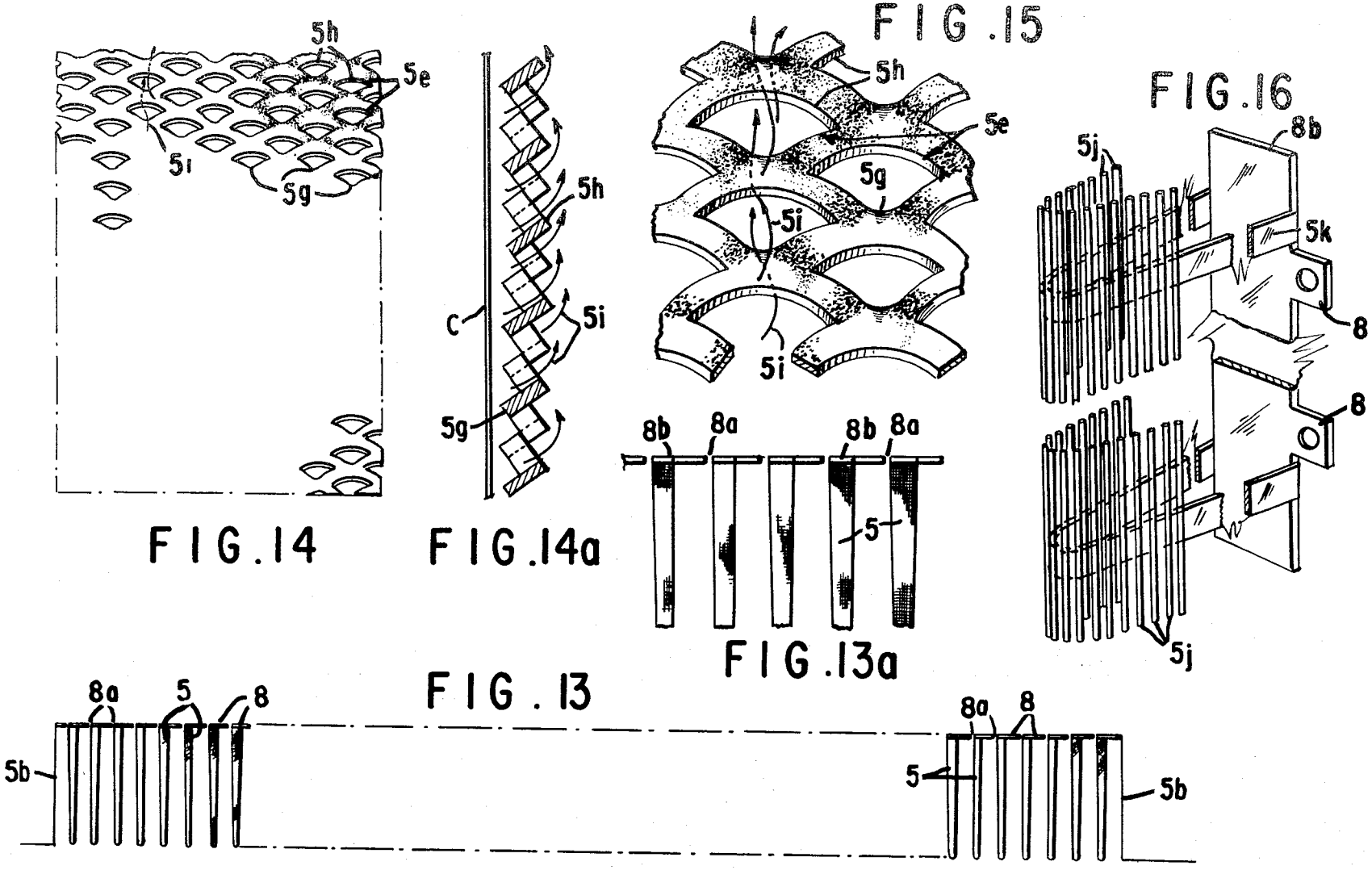

FIG. 5*a* is a partial perspective view of two cell units with parts broken away;

FIG. 6 is a part-sectional view of the feed line assembly used in each cell unit;

FIg. 7 is a side view, partially in section, of the brine level equalizer and brine level indicator;

FIG. 8 (Sheet 3) is a side view, partially in section, of a cathode end frame;

FIG. 9 is a side view of one of the cathode fingers;

FIG. 10 is a part-sectional end view of a cathode finger, substantially along the line 10 — 10 of FIG. 9;

FIG. 11 is a sectional plan view of a cathode finger, substantially along the line 11 — 11 of FIG. 9;

FIG. 12 is a face view of a cathode finger;

FIG. 13 is a plan view of an anode assembly and

FIG. 13*a* is an enlarged area of FIG. 13;

FIGS. 14, 14*a* and 15 are details of the anode wall construction;

FIG. 16 shows vertically mounted rod anodes;

FIG. 17 is a sectional plan view of the anode end of a modified cell construction; and FIG. 18 is a sectional plan view of the cathode end of the modified cell of FIG. 17.

Figure 2:
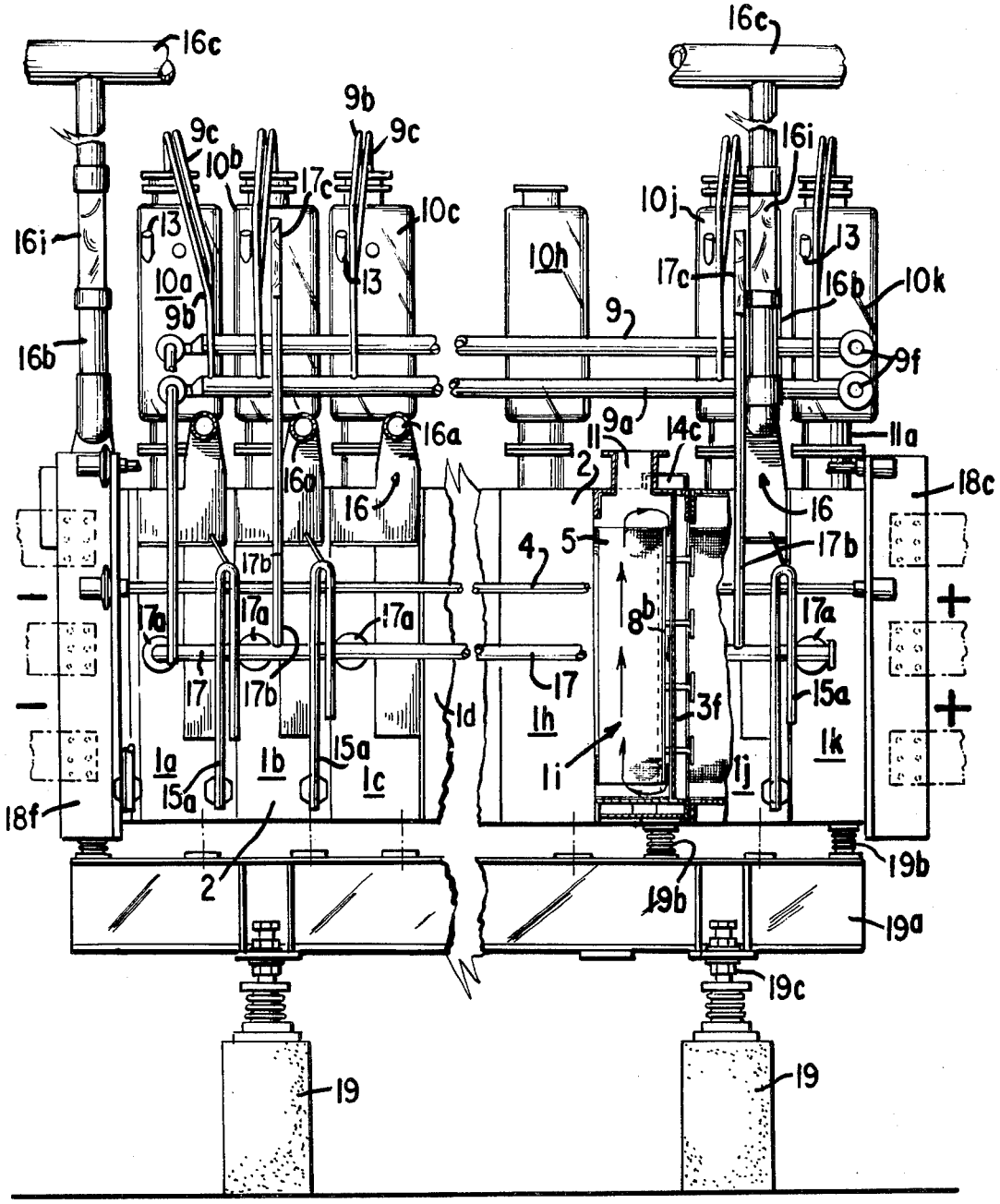
FIG. 2 is a part-sectional side view, with parts broken away and portions omitted, of the cell illustrated in FIG. 1.

The bipolar cell of this invention comprises a plurality of rectangular cell units, $1^a$ - $1^b$ - $1^c$ - $1^h$ - $1^i$ - $1^j$ - $1^k$, etc.-(FIG. 2). The number of cell units may vary according to the capacity desired. The embodiment illustrated comprises 10 bipolar cell units, an anode end element and a cathode end element, making 11 individual cell units in bipolar connection. The number of such units may be larger or smaller than illustrated. Each cell unit has a brine box, 10*a*, 10*b*, 10*c*, 10*d*, 10*e*, 10*i*, 10*j*, 10*k*, preferably mounted on the top thereof (FIG. 3) although the brine boxes may be suspended above the cell units and connected thereto. Any cell unit may be used as a single unipolar cell and current connection between one or more separate unipolar cell units may be provided. Each cell unit is mounted in a rectangular metal frame 2, with end flanges 2*a* (FIGS. 4,5 and 5*a*), which abut against similar end flanges of the adjacent cell frames 2. Suitable insulating gaskets 2*b* are provided between the flanges of each intermediate frame unit which, together with the long bolts 4, maintain the assembled cell units in fluid-tight connection. The frame 2 of the anode end element $1^k$ is welded or otherwise secured to the anode end plate $3^a$, as illustrated at $2^c$ in FIG. 4. The flanges $2^a$ of the rectangular frame 2, adjacent the cathode end element $1^a$ abuts against a flanged cathode end frame $2^d$, with an insulating gasket $2^b$ between each set of flanges $2^a$, as shown in FIG. 5. The flanged cathode end frame $2^d$ is welded or otherwise secured to the cathode end plate $3^c$.

The assembly of cell units is held together by a plurality of long bolts 4 covered with plastic sleeves $4^c$ and suitably insulated from the end plates $3^a$ and $3^c$. The cathode end of each long bolt 4 is provided with spring washers $4^a$ and detachable nuts $4^b$, as illustrated in FIGS. 4 and 5. The long bolts are spaced from the rectangular frames 2 and flanges $2^a$.

The intermediate units of the bipolar cell illustrated are all substantially the same. The anode end element and the cathode end element of each cell assembly differ from the intermediate units in the construction necessary to secure the positive electrical connections to the anode end and the negative connections for the cathode end of the cell assembly, and in other details necessary at the end units more particularly as illustrated in FIGS. 4 and 5.

Each rectangular frame 2 houses a series of anodes 5 and cathodes 6 within the frame 2. The anodes 5 and cathodes 6 are preferably in nested, hollow finger or wave form, as illustrated in FIGS. 4 and 5 (also FIGS. 13, 17 and 18), but may be flat plates or have other forms. The hollow wave form provides greater anode and cathode surface within the frames 2 than any other form. The anodes 5 are formed of a metal resistant to anodic conditions, such as titanium, tantalum zirconium, niobium or other valve or film forming metal or alloys of these metals. The walls of each anode compartment, where exposed to the anolyte and anodic conditions, are lined with a corrosion-resistant lining, such as titanium or tantalum or alloys thereof $5^a$, or a suitable polyester or other resin plastic. The titanium, tantalum or other valve metal of the anodes 5 may be solid, reticulated, rod, screen or other open form. The anodes are coated on either the inside or outside, or both sides of the hollow fingers 5, with an electrically conducting electrocatalytic coating, such as one containing a platinum group metal or a platinum group metal oxide together with titanium and/or other metals or oxides as desired, such as described, for example, in U.S. Pat. Nos. 3,632,498 and 3,711,385.

The cathode fingers 6 are preferably formed of metal screen $6^a$ (FIGS. 5 and 11) and project from a metal screen backing $6^b$. The cathode waves or fingers are closed at the top and bottom with metal screen material. A suitable diaphragm of asbestos or an ion-permeable diaphragm material may be applied to the screens $6^a$ and $6^b$ to separate the anode compartment of each cell unit from the cathode compartment. Suitable reinforcements $6^c$ may be provided in the interior of the screen cathode fingers to prevent them from collapsing if the diaphragm material is deposited by vacuum on the screen fingers. The diaphragm material covers the side walls as well as the top and bottom of the cathode fingers 6 and the screen backing $6^b$. The diaphragms $6^g$ are only partially and diagramatically shown by the dash lines in FIGS. 11 and 12, but it will be understood that the fingers 6 and backing screens $6^b$ are completely covered with diaphragms. The backing screens $6^b$ are spaced from the cathode compartment end walls $3^c$ and $3^f$ by back screen supports $6^h$. The diaphragms are omitted for chlorate, perchlorate or other electrolysis process is which diaphragms are not necessary, and for this use flat solid anode plates are preferably used.

In chlorine production, for example, the diaphragms separate the anolyte compartments from the catholyte compartments and keep the gases formed in each of these compartments separate, as is well understood in the diaphragm cell art. In the case of chlorine and caustic production from a sodium chlorine brine, the diaphragms keep the chlorine released at the anode from mixing with the sodium hydroxide and hydrogen formed at the cathode. This type of cell, when used for chlorine-caustic soda production, usually operates at a current density of about 2045 amps/$m^2$ and a cell voltage in the individual cell units of about 3.40 to 3.60 volts. The anolyte compartments are operated as completely flooded with anolyte, except for any anolyte gas bubbles which may be moving under the cell cover.

The anodes waves or fingers 5 and the individual cathode fingers 6 are separately formed, assembled and welded to a series of spaced anode support bars $8^b$ and to the cathode back screens $6^b$, respectively. The anode support bars $8^b$ are connected by means of a series of spaced titanium assembly lugs 8 to titanium studs $7^b$ connected to the titanium lining $5^a$ of the anode compartments preferably by welding. This permits separate manufacture and assembly of the individual anodes and cathodes and coalignment of the composite connector rods formed by 7, $7^a$, $7^b$, $6^f$, etc., extending between the anodes and cathodes, which produces better conduction and reduces resistance losses in the cells.

The anode end plate $3^a$ is provided with a series of rows of circular openings $3^d$. Pre-assembled composite connector rods formed by a steel plug 7, a copper insert $7^a$ and a titanium stud $7^b$, preferably welded together by friction welding, are welded into holes $3^d$ as shown in FIG. 4. The titanium lining $5^a$ of the anode compartment is welded to the titanium studs $7^b$, as shown in FIG. 4, and titanium anode supports 8, are welded to the titanium studs $7^b$. Anode support bars $8^b$, extending substantially for the entire height of the anode fingers are secured through the assembly lugs 8 to the titanium studs $7^b$ and form a wall, dividing the interior of the anode compartments into a front portion housing the anode fingers 5, and a rear portion $5^k$, behind the anode of fingers into which the anolyte which has been brought to the top of the anode fingers 5 by the gas lift effect of the anodic gases in the front portion of the anode compartment can be recirculated downward in the spaces $5^k$ to the bottom of the anode compartment. A small gap $8^a$, is left between the anode supports 8 and the anode support bars $8^b$ which together with the openings between the spaced assembly lugs 8 allow restricted flow of anolyte between the front and the back of the anode compartments. The gaps $8^a$ and the spaces between the anode assembly lugs 8 are relatively small as compared to the solid areas of the anode support bars and the assembly lugs 8. The ratio of solid walls $8^b$ to the openings $8^a$ is about 6 to 1. This ratio is, however, not critical and the ratio between the solid area and the open area of the separating walls may be slightly larger or smaller.

The reticulated titanium fingers 5 are welded at each side of the base of the fingers 5 to the anode support bars $8^b$. Only two anode fingers 5, one anode finger end wall $5^b$ and two anode support lugs 8 are shown in FIG. 4, but it will be understood that the series of anode fingers 5 extends from side to side of each cell unit with an end finger $5^b$ at each end of the series of anode fingers 5, as illustrated in FIGS. 4 and 13, and that corresponding cathode fingers 6 extend between each anode finger 5, as illustrated on a larger scale in FIGS. 4 and 5.

The anode support bars $8^b$ provide a wall behind the hollow interior of the anode fingers 5, whereby a portion of the electrolyte which is carried upward in the interelectrodic gap $5^c$ and in the interior of the hollow anode fingers 5 by the rising anodic gas bubbles (chlorine) is recirculated downward in the spaces $5^k$ behind the wall of bars $8^b$ to the bottom of the anode compartments, thus providing up and down circulation from the front to the back of each anode compartment. The open spaces in the wall permit some equalizing flow of electrolyte between the back space $5^k$ and the front portion of the anode compartment but do not interfere with the up and down recirculation of the anolyte. The higher current density at which these cells operate produces a large volume of bubbles in the front portion of the anode compartment, which causes a vigorous upward flow of the electrolyte contained in this portion of the anode compartment and induces a downward movement of the electrolyte within the back space $5^k$.

In each cell unit, the base of each screen cathode finger 6 is welded to a cathode backing screen $6^b$ through a flared portion $6^d$, which is also welded to a plurality of short steel bars $6^e$ (see FIGS. 9 to 11). Round steel bars $6^f$ are welded, preferably friction-welded, to the short steel bars $6^e$, a copper plug insert $7^a$ is preferably friction-welded at the end of each steel bar $6^f$ and for the intermediate cell units a titanium stud $7^b$ is welded, preferably friction-welded, to the copper plug insert $7^a$. The round steel bars $6^f$ are welded into holes provided in the intermediate separating partitions $3^f$ of the intermediate cell units (FIGS. 4 and 5) and the titanium lining $5^a$ on the anodic side of the intermediate separating partition $3^f$ is welded to the titanium studs $7^b$.

The cathode fingers 6 are then welded to the short steel bars $6^e$ and to the backing screen $6^b$ and the anode fingers 5 are welded or otherwise connected to the titanium studs $7^b$ by means of the assembly lugs 8 extending from the anode support bars $8^b$.

The titanium linings $5^a$ and the titanium studs $7^b$ provide a complete separation of the anode compartments from anodic steel end wall $3^a$ and from the steel walls $3^f$ of each of the intermediate separating partitions between the intermediate cell units. The lining $5^a$ and the studs $7^b$ provide a continuous, imperforate titanium wall between the anode compartments and the cathode compartments and prevent the anolyte and anodic gases from contacting the steel end walls $3^a$ and the intermediate steel walls $3^f$. The intermediate walls $3^f$ welded to the round steel bars $6^f$ provide a continuous imperforate steel wall between the cathode compartments and the back of the titanium linings $5^a$ and prevent any catholyte or catholyte products from contacting the titanium linings of the anode compartments. In the embodiments of FIGS. 1 to 11, the titanium linings $5^a$ are not welded to the steel back plates $3^a$ or $3^f$ and the current essentially flows, between the cell units, along the friction welded composite connectors $6^e$, $6^f$, $7^a$ and $7^b$.

At the terminal cathode end unit illustrated in FIG. 5, the steel bars $6^f$ extend into holes $3^e$ through the cathode end plate $3^c$ and are welded therein. Cathode back screen support bars $6^h$ extend between the intermediate steel separating plates $3^f$, the terminal cathode end plate $3^c$ and the cathode back screens $6^b$ in each cathode compartment, to support the cathode back screens and provide a space back of screens $6^b$ for free discharge of catholyte liquor and hydrogen to the rear of the cathodes. The copper plugs $7^a$ prevent hydrogen migration through the steel cathode structures into the titanium structures of the cell, which would form titanium hydride and eventually destroy the cell.

As described previously, the interior of each anode compartment is provided with a lining $5^a$ of titanium or other lining material resistant to anodic conditions. Side walls $5^b$ at each end of the anodes waves 5, the interior of frames 2, and the anodes and all connections within the anode compartment are made of titanium or other valve metal, which extends over at least a portion of the flanges $2^a$.

The interior of the cathode compartments, the cathodes per se, the screen backing for the cathodes, etc., are preferably steel or other ferrous metal which is resistant to cathodic conditions.

For chlorine production the diaphragms on the cathodes and cathode back screens separate each cell unit into an anodic compartment and a cathodic compartment and permit flow of electrolyte through the diaphragms, whereby hydrogen is released at the cathodes to produce hydrogen gas and the sodium ions which combine with the $OH^-$ ions to form sodium hydroxide, and chlorine is released at the anodes.

The intermediate steel separating partitions $3^f$ and the titanium linings $5^a$ provide imperforate partitions between each of the intermediate cell units $1^b$, $1^c$, etc. The anode end element $1^k$ is likewise lined with titanium $5^a$, while the cathode end plate $3^c$ and the cathodic interior of the cathode end unit are steel or other ferrous metal. When chlorates, perchlorates, etc., are produced, the diaphragms are omitted, but the operation of the cell is otherwise the same.

Figure 1:
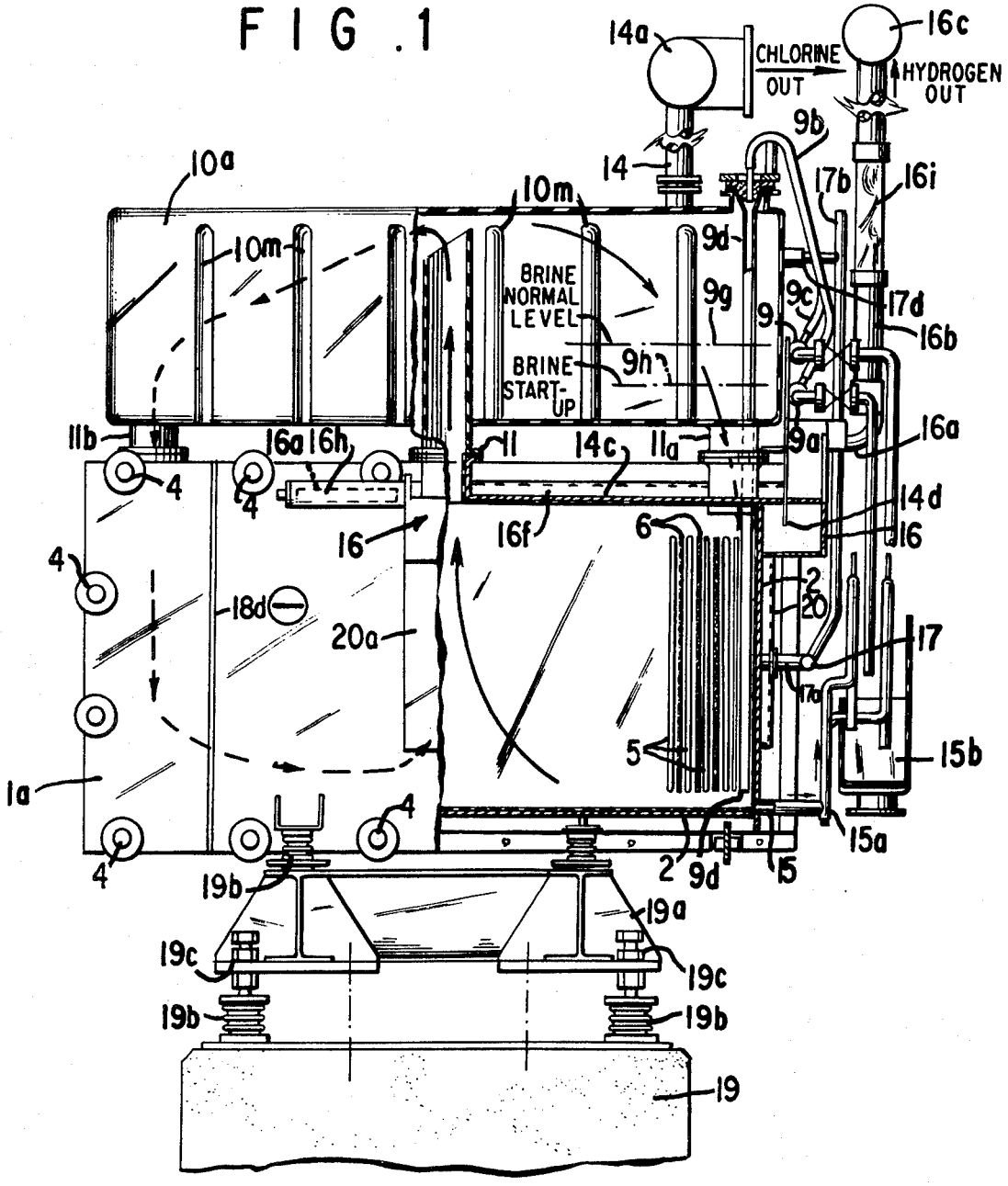
FIG. 1 is a front view, partially in sections, substantially along the line 1 — 1 of FIG. 3, of a bipolar cell.

Brine is introduced into each cell unit $1^a$, $1^b$, $1^c$, $1^j$, $1^k$, through brine headers 9 or $9^a$ connected to a brine supply source $9^f$ (FIG. 2). Header $9^a$ is used to fill and start operation of the cell with unsaturated brine, for purging the cells during shutdowns and as an auxiliary supply line in case of any failure or stoppage of the supply of saturated brine through the header line 9. Header 9 is used for normal operation with saturated brine. The use of unsaturated brine during the start-up prevents crystallization of salt in the cells, feed lines, etc. until the cells have reached their normal operating temperature. The brine level in the brine boxes during normal operation is shown by the line $9^g$ (FIG. 1), and the brine start-up level by the line $9^h$. From the headers $9^a$ or 9, the brine flows through brine feed hoses $9^b$ or $9^c$ into brine feed funnels $9^d$ in each of the fiber glass-reinforced polyester brine boxes $10^a$, $10^b$, $10^c$, $10^h$, $10^g$ and $10^k$ located above top of each of the cell units $1^a$, $1^b$, $1^c$, $1^i$, $1^j$, and $1^k$. The brine feed hoses are provided with shut-off clamps, etc. The brine feed funnels or dip tubes $9^d$ extend through the brine box approximately to the bottom of each of the cell units $1^a$, $1^b$, etc., as shown in FIG. 1, so that the fresh brine is delivered to or below the bottom of the anode fingers 5. The anode fingers 5 and cathode fingers 6 extend approximately from the top to the bottom of the anode and cathode compartments, but are spaced a short distance from the bottom and top of these compartments, as shown in FIGS. 1 and 2, to permit circulation and recirculation of the electrolyte within the cell units and permit escape of anodic and cathodic gases.

Each of the brine boxes $10^a$, $10^b$, $10^c$, etc., is connected with its corresponding cell unit $1^a$, $1^b$, $1^c$, etc., by brine box connections $11^a$ and $11^b$ at each end and a gas riser 11 at the center. The bottom of the gas riser 11 is flush with the top of each anode compartment and the top extends close to the normal operating brine level or just above it so that most of the chlorine (or other anodic gas) flows into the brine boxes through the center connection. The connections $11^a$ and $11^b$ extend a short distance below the top of the anode compartments and into the brine in the flooded anolyte compartment. Fresh brine flows downward through feed funnel $9^d$ and connections $11^a$, and recirculated brine flows downward through connections $11^a$ and $11^b$ into the anode compartments, so that, in operation, there is a constant recirculation of brine or anolyte downward at each end of the cell units $1^a$, $1^b$, $1^c$, etc., and upward, together with chlorine through gas riser 11 in the center of each brine box $10^a$, $10^b$, etc., as indicated by the arrows in FIG. 1. Recirculation of the anolyte from the front to the back of each anode compartment of cell unit $1^a$, $1^b$, $1^c$, etc. is provided at the same time by the chlorine gas bubbles rising in the interelectrodic gaps $5^c$ between the anodes 5 and the diaphragm covered cathodes 6 and in the spaces $5^d$ inside the hollow anode fingers 5, which carry the anolyte upward to the top of the anode compartments where a portion of the anolyte separates from the gas bubbles and flows downward in the spaces $5^k$ behind the anode support bars $8^b$, as shown by the arrows in the sectioned cell $1^i$ in FIG. 2.

Most of the chlorine gas bubbles, upon reaching the top of the anode compartment, escape through the gas riser 11 imparting an upward thrust to the electrolyte present inside the gas riser 11. The electrolyte rises with the gas to the top of the riser 11 and overflows into the electrolyte pool in the brine boxes $10^a$, $10^b$, etc., whereby the chlorine gas separates from the brine. Simultaneously an equivalent volume of electrolyte moves down through the connections $11^a$ and $11^b$ and enters the anode compartment near the side walls of the compartment.

The dotted circle $11^a$ in FIG. 5 shows the approximate location of the downcoming connection $11^a$ with reference to the anode compartment width.

In this way, a circulation motion of the electrolyte to and from the anode compartment and the cooperating brine box is created. This motion, in cooperation with the recirculation motion of the anolyte within each anode compartment resulting from the division of the anode compartment by the separating wall formed by anode support bars $8^b$ into a front portion, affected by the upward flow of the gas and of the anolyte, and rear portion $5^k$ (FIG. 4) wherein anolyte brought to the top of the anode compartment is recirculated to the bottom of the compartment, produces an intense recirculation of the anolyte from near the side walls towards the center of the anode compartment and through the brine box riser 11 and downcomers $11^a$ and $11^b$ and from the front to the back or from the top to the bottom of the anode compartment.

The advantages of such a recirculation are many; the composition and temperature of the anolyte are maintained substantially uniform through the cell, the two recirculation motions facilitates rapid evacuation of the gas bubbles from the interelectrodic gap and their disengagement from the electrolyte and allow the full exploitation of the upward thrust imparted by the rising gas bubbles to the electrolyte; the fresh brine, fed into the cell through the feed funnels $9^d$, to make up for the electrolyte which percolates through the diaphragm into the cathode compartments during the operation of the cell, is immediately drawn into circulation. In this way, the cell can tolerate high current densities with very high current efficiencies.

As an alternative to the embodiment illustrated, the brine boxes $10^a$, $10^b$, $10^c$, etc. may be substituted by a single brine box for a multiplicity of cell units $1^a$–$1^k$. In this case the gas risers 11 from each cell unit may be connected to a common collector which extends into the brine box to a height close to or just above the normal brine level while the downcomers $11^a$ and $11^b$ for each cell unit, for the return of the electrolyte, may start from a common distributor pipe connected to the bottom of the brine box.

The connections $11^a$ and $11^b$ may alternatively be extended to the bottom of the anode compartment or in its proximity, while the gas risers 11 should be as vertical as possible and free of sharp bends or of horizontal sections. The top of the anode compartments may also slope slightly upwards to the gas riser to favor the escape of the gas bubbles reaching the top of the compartment.

Another advantage of the cell of the invention is that the intense recirculation motion of the anolyte allows diaphragm material such as asbestos fibers or powders to be kept in suspension. The diaphragms deposited over the cathode screens are subject to wear and deterioration. In diaphragm cells of the prior art it is necessary to completely renew the asbestos diaphragm every three to seven months of operation. In the cell of the present invention it is possible to introduce a certain amount of asbestos either in fiber or in powder form in the anolyte periodically or when needed. The asbestos fibers, so introduced, are maintained in suspension in the anolyte and are slowly deposited onto the diaphragms, especially at places where the porosity is greater. In this way, limited worn areas of the diaphragm, small holes, etc. become covered with an additional layer of asbestos which prevents the erosion of the diaphragms from proceeding unhindered to an irreversible rupture of the diaphragm and maintains optimum diaphragm porosity during normal cell operation.

Stoppered diaphragm feed inlets 13 are provided at the brine feed end of each brine box $10^a$, $10^b$, $10^c$, etc., through which new diaphragm material may be introduced into the cell units as the diaphragms are eroded or deteriorate in service. The diaphragm material is introduced as a slurry or as moist solid sticks through inlets 13, and is carried downward by the recirculating brine through connection $11^a$ to below the bottom of the diaphragm covered cathodes and recirculated upwardly along the cathode fingers 6 and cathode screens $6^b$, where it deposits on any portion of the diaphragm where more diaphragm material is needed to repair the more porous areas which have developed in the diaphgrams.

From the brine boxes $10^a$, $10^b$, $10^c$, etc., the chlorine, separated from the brine, flows through chlorine outlets 14 from each brine box into a chlorine header $14^a$ leading to a chlorine manifold outlet $14^b$ which is connected to a chlorine recovery or disposal system.

Figure 3:
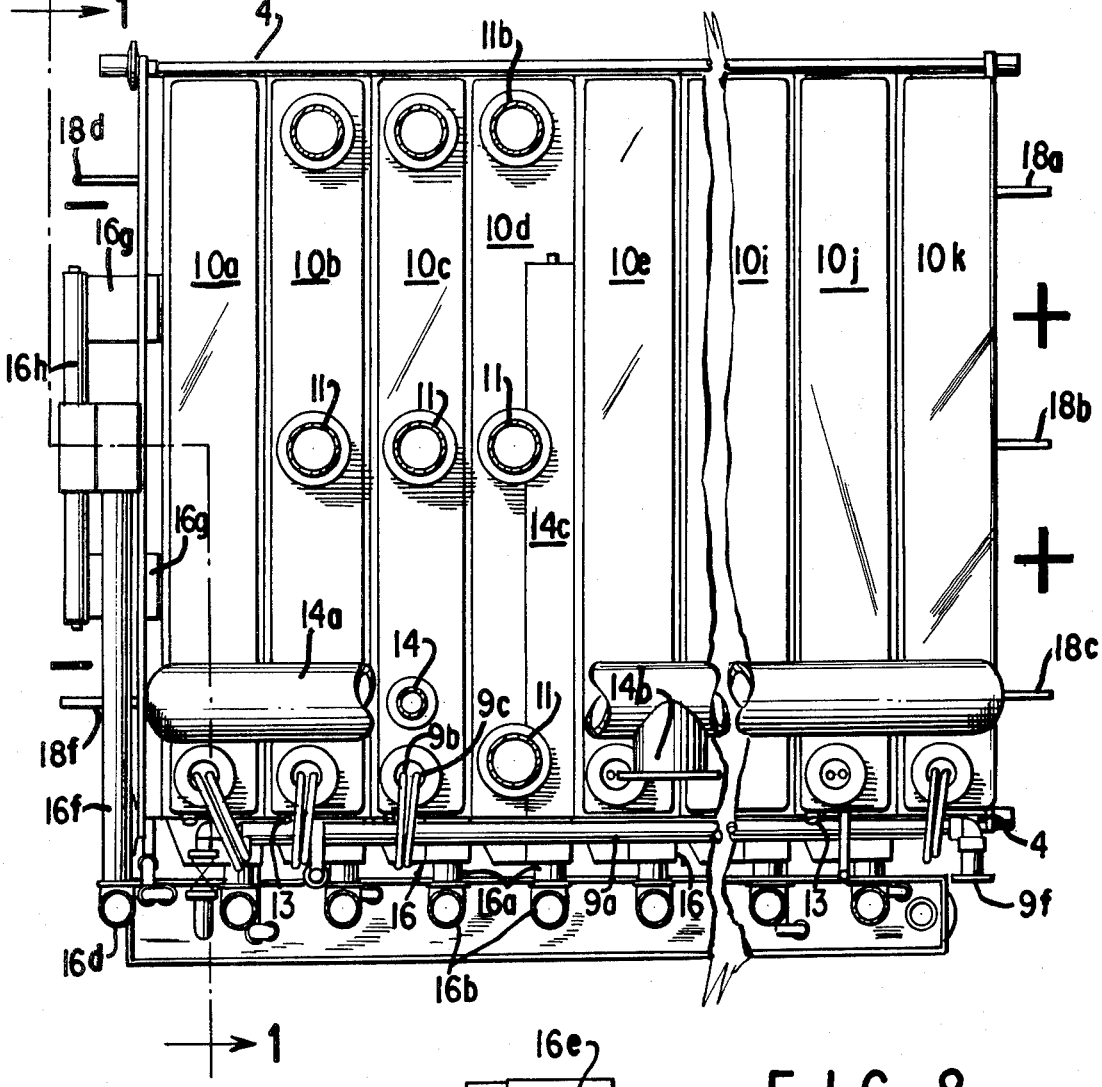
FIG. 3 is a plan view of the bipolar cell illustrated in FIGS. 1 and 2, with portions of the cell omitted.
Figure 4:
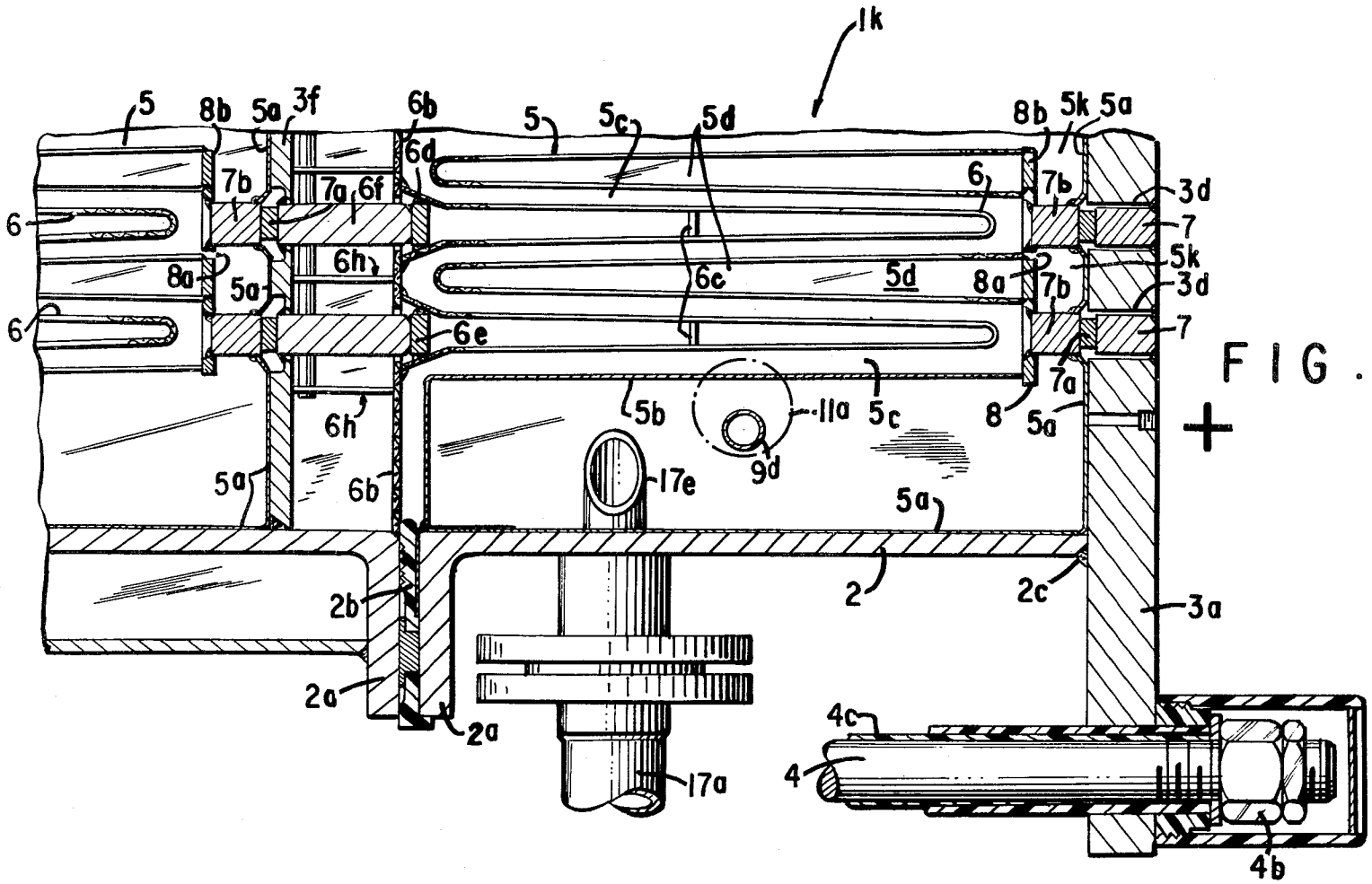
FIG. 4 is an enlarged sectional plan view of a portion of the bipolar cell unit at the anode end of the cell, showing one intermediate separating partition.

As the depleted brine flows through the diaphragms on cathodes 6 and cathode backing screens $6^b$, hydrogen is released at the cathodes and the sodium ions combine with the $OH^-$ ions to produce sodium hydroxide. The sodium hydroxide flows out of each cell unit $1^a$, $1^b$, $1^c$, etc., through a caustic outlet 15 adjacent the bottom of each cathode chamber in the cell units and into pivotted, inverted U-shaped caustic liquor discharge or perc pipes $15^a$, which discharge the caustic into a cell liquor through $15^b$, from which it flows to a caustic recovery or disposal system. The position to which the inverted U-shaped, pivotted pipes $15^a$ are turned determines the catholyte level in each of the cell units $1^a$, $1^b$, $1^c$, etc., and controls the flow of anolyte through the diaphragms which depends on the hydrostatic pressure difference across the diaphragms. Hydrogen released in the cathode compartment of each of the bipolar units and separated from the catholyte liquor flows through a hydrogen channel $14^c$ along the top of each cathode compartment to the end of the cell units $1^b$, $1^c$, etc., where it flows under baffles $14^d$ and through openings (not shown) into a hydrogen discharge box 16 (FIG. 1) and through an opening in the top of box 16 into a hydrogen outlet pipe $16^a$ and pipes $16^b$ to a hydrogen manifold $16^c$ and then to a recovery system. The hydrogen outlet for the intermediate elements is at the end of each cell unit. Each of the hydrogen outlet pipes $16^b$ is provided with a pyrex glass section $16^i$ which permits inspection of the hydrogen flow and insulates the hydrogen discharge system from the cell currents. The hydrogen outlet for the terminal cathode end element is on the side of the cathode end element and is indicated at $16^d$ (FIG. 3). The hydrogen from the terminal cathode chamber in cell unit $1^a$ flows from the center of the cell unit through outlets $16^g$ in the cathode end element into hydrogen gatherer $16^h$, which connects with extension pipe $16^f$ extending between the center of cathode end plate $3^c$ and the hydrogen outlet pipe $16^d$ for the terminal cathode unit.

A catholyte liquid return channel 20 (FIGS. 1 and 5*a*) extends from the hydrogen discharge box 16 at the top of each cell unit to the lower part of each catholyte chamber, to return any catholyte liquor in the hydrogen discharge stream to the cathode compartments. In the cathode end element a catholyte liquor return channel $20^a$ at the center of this element also returns catholyte liquor to the cathode compartment in the cathode end element.

FIG. 5*a* shows a portion of two intermediate cell units in which unit $1^b$ is a substantially complete unit and unit $1^c$ is partially broken away to show the interior construction. Unit $1^c$ shows only the diaphragm covered cathodes 6 with the back screen $6^b$ and supports $6^h$ spacing the back screen $6^b$ from the steel portion of an intermediate separating and supporting plate $3^f$. Unit $1^c$ shows the nested titanium anode fingers 5 and cathode fingers 6. The hydrogen channel $14^c$ discharges hydrogen into the hydrogen discharge box 16 from which it flows into the $H_2$ outlet pipe $16^a$, equipped with a pyrex glass section $16^i$, and the catholyte liquor flows into the catholyte liquid return channel 20.

Each of the anode compartments is connected to an equalizing header pipe 17 extending along the entire cell, by means of outlet pipes $17^a$ (FIGS. 1, 4 and 7) from each cell unit. Each outlet pipe $17^a$ has an insulating connection pipe $17^e$ (FIG. 7) which projects through the element nozzle $17^f$ into the anolyte compartment to protect the titanium lining $5^a$ of the anolyte compartment from electrolytic corrosion. Near each end of the header pipe 17, brine level indicator pipes $17^b$, provided with transparent upper portions $17^c$ of pyrex glass or other suitable material, extend upward and are connected into the brine boxes $10^b$ and $10^j$ by connectors $17^d$. The brine header 17 connected with each cell unit $1^a$, $1^b$, $1^c$, etc., assures that the proper brine level will be maintained in each cell unit.

Positive terminal connectors $18^a$, $18^b$ and $18^c$ are provided at the anodic end of the cell for connection with a suitable DC current, and negative terminal connectors $18^d$, $18^e$ and $18^f$ are provided at the cathodic end of the cell.

FIG. 13 shows a plan view of the anode fingers 5 and the titanium anode end fingers $5^b$ as they are provided in each cell unit and FIG. $13^a$ is an enlarged area showing the separating wall formed by the anode support bars $8^b$ and assembly lugs 8 and the gaps $8^a$.

FIGS. 14 and 14*a* illustrate the expanded sheet metal reticulated type anodes 5 made of titanium, tantalum or other valve metal, provided with an electrically conducting electrocatalytic coating (not shown in the drawings) on at least one face of the anode. The coated face of each anode is preferably opposite a diaphragm covered cathode face 6, with the interelectrodic gap therebetween. These anodes have diamond-shaped openings $5^e$, in which the bottom central portion $5^g$ of each diamond is rearward of the vertical center plane of the anode and the top central portion $5^h$ of each diamond is forward of the vertical center plane of the anode face. The corners of each diamond-shaped opening lie approximately in the vertical plane of the anode. The lower half $5^g$ of each diamond-shaped opening is tilted or pushed toward the cathode C (FIG. 14*a*), while the upper half $5^h$ of each diamond-shaped opening is tilted or pushed away from the cathode C, so that gases released on the lower half of and below each diamond-shaped opening pass through said opening to the back or rear of the anode (away from the cathode) and are deflected rearwardly of the anode by the forwardly tilted upper half of the diamond-shaped opening and into the electrolyte space at the rear or inside the hollow fingers 5 of the anode, as indicated by the arrows $5^i$ in FIGS. 14*a* and 15. In FIG. 14, the solid portions of the arrows $5^i$ indicate the path of the gases along the lower leg of each diamond-shaped opening and the dotted portion of the arrows indicate the path of the gases behind the upper portion of each diamond-shaped opening and away from the cathode. By this construction most of the gas released along the legs which are tilted to the rear of the anode, when released into the diamond-shaped opening, is deflected to the rear of the anode by the legs which are tilted toward the front of the anode. In this way, most of the gases released along the coated face of the anodes are directed through the opening in the anodes and deflected to the interior 5 of the anode fingers 5, away from the interelectrodic gap between the anode faces and the cathodes and their diaphragms. FIG. 15 is an enlarged area of the anode of FIG. 14.

While diamond-shaped openings $5^e$ have been illustrated in FIGS. 14, 14*a* and 15, it will be understood that square, round, triangular, hexagonal or other shaped openings may be provided in anode faces, with the lower portion of each opening tilted toward the side of the anode facing the cathode and the upper portion of each opening tilted or pushed toward the side of the anode facing the interior $5^d$ of the anode fingers, to accomplish the same object, namely, to pass the gases released at the front of each anode through the opening therein and deflect them to the rear of each anode and into the interior of the hollow anode fingers which provide a larger area for the escape of the anodic gases than the interelectrodic gap per se.

Instead of reticulated metal, the walls of the anodes may be formed of spaced titanium rods $5^j$, vertically mounted on suitable supports $5^k$, attached to anode support bars $8^b$, as illustrated in FIG. 16, in which the anodic gases formed in the interelectrodic gap readily pass between the rods and into the hollow interior of the anode fingers.

FIGS. 17 and 18 illustrate a modified construction, in which the anode fingers 5 are mounted on support bars $8^b$ having gaps $8^a$ between each support bar, and the anode assembly lugs 8. The anode assembly lugs 8 are connected by welding, or otherwise, to titanium studs $7^b$ welded to an imperforate titanium liner $5^a$, which is on the anodic side of the positive end steel support plate $3^a$ and of the intermediate steel supporting plates $3^f$. In this embodiment the titanium lining $5^a$ is welded to the steel plates $3^a$ and $3^f$ so that current flows through the end plates $3^a$–$5^a$ and the intermediate separating partitions $3^f$–$5^a$ from the anodes to the cathode end of the cell. The screen cathodes 6 in FIGS. 17 and 18 are mounted between the anodes 5, as described in connection with FIGS. 4 and 5, on angular steel supports $6^h$, which project from the cathode end plate $3^c$ and the intermediate steel partitions $3^f$, so that the anode end plate $3^a$, the cathode end plate $3^c$ and the intermediate partitions $3^f$ do not have holes therethrough. For chlorine production the cathodes 6 are provided with diaphragms as described previously. The other portions of FIGS. 17 and 18 are similar to like parts in FIGS. 4 and 5.

In both the main embodiments of FIGS. 1 to 16 and the modified embodiment of FIGS. 17 and 18, the titanium linings $5^a$ and titanium studs $7^b$ form an imperforate valve metal lining for the anode compartments, and the valve metal support studs $7^b$ projecting from the lining $5^a$ support the anode fingers mounted on anode support bars $8^b$, so that the bases of the hollow anode fingers are spaced from the lining $5^a$ of the anode compartments to provide a downward recirculating space $5^k$ for the electrolyte behind the support bars $8^b$.

The cell is mounted on a suitable insulated base 19, supporting channel members $19^a$, insulators $19^b$ and adjustable levelling bolts $19^c$. Teflon sliding plates (not shown) on channel members $19^a$ permit sliding the element along the support for assembly and disassembly.

The fiberglass-reinforced polyester brine boxes $10^a$, $10^b$, $10^c$, etc. have strengthening indentations $10^m$ (FIG. 1) formed in their side walls, which, however, do not prevent flow of brine from end to end of the brine boxes. The space above the brine normal level indicated in FIG. 1 is occupied by chlorine and whatever foam is formed, and the flow of brine from the center chlorine outlet 11 to the down connections $11^a$ or $11^b$ tends to break the foam and release chlorine bubbles trapped therein.

The embodiments of the invention shown, are for illustrative purposes only, and various modifications and changes may be made within the spirit and objects of this invention. The cells illustrated may be used as unipolar single cells or as bipolar multiple cells, and while titanium and steel have been described as the preferred metals of construction, any valve metal or film-forming metal may be used for the anodic portions and any ferrous metal may be used in the cathodic portions of the cells and various dissimilar metals may be used for the anodic and cathodic portions of the cell units. Examples of other suitable anode metals are lead, silver and alloys thereof and metals which contain or are coated with $PbO_2$, $MnO_2$, $Fe_3O_4$, etc., and examples of other suitable cathode metals are copper, silver, stainless steel, etc. The metals and plastics used should be suitable to resist the corrosive or other conditions encountered in the anode and cathode compartments and other portions of the cells when operating on a particular electrolyte. While diaphragms on the cathodes will usually be used, diaphragms may be used on both anodes and cathodes. When non-porous ion-selective membranes are used as diaphragms a continuous recycling of at least a portion of the anolyte and of the catholyte must be provided in order to keep the concentrations of both the anolyte and of the catholyte constant. The cells can be used without diaphragms for certain purposes, such as chlorate, perchlorate, hypochlorite, periodate production, and for other electrolysis processes in which diaphragm separation of the electrolysis products is not necessary. In such cases the entire cell compartment and the structures therein must be made of suitable material that is non-corridible by the electrolyte and the products of the electrolysis. The cathode structures are preferably made exactly as the anode structures thus providing two recirculation spaces behind the walls supporting the electrodes so that the gas liberated on the electrodes flows upwards in the central portion of the cell compartment and part of the electrolyte brought to the top of the compartment is recirculated to the bottom of the compartment through the spaces behind the two walls formed respectively by the assembly of the anode support bars and by the assembly of the cathode support bars.

What is claimed is:

1. In an electrolysis cell unit having a diaphragm separating said cell unit into an anode compartment and a cathode compartment, metal anodes in hollow finger form in said anode compartment, nested with cathodes in hollow finger form in said cathode compartment, the bases of said anodes being mounted in a support wall spaced from the anode compartment end wall of said cell unit, an electrolyte in said cell unit, means in said support wall to permit restricted flow of electrolyte therethrough, means to feed electrolyte into said cell unit and means to pass an electrolysis current through said cell unit, the method which comprises circulating the said electrolyte upwardly in the electrolysis gap between said anodes and cathodes and in the interior of said hollow fingers of said anodes by the lifting effect of the anodic gases formed in the electrolysis, separating the gases from the electrolyte and passing a portion of said electrolyte downward in the space between the anode support wall at the base of said anodes and the anode compartment end wall to circulate said anolyte upwardly in the front of said anode support wall and downwardly in the rear of said anode support wall.

2. The method of claim 1, in which a diaphragm material is periodically fed into said cell unit and circulated past said diaphragm to deposit diaphragm material on said diaphragm.

3. The method of claim 1, in which a plurality of said cell units are combined together in a bipolar cell and the electrolysis current is passed through the entire cell.

4. In an electrolysis cell unit having a diaphragm separating said cell unit into an anode compartment and a cathode compartment, metal anodes in hollow finger form in said anode compartment, nested with cathodes in hollow finger form in said cathode compartment, the bases of said anodes being mounted on a support wall, spaces from the anode compartment end wall of said cell unit, means in said support wall to permit restricted flow of electrolyte therethrough, a brine box on said unit, an electrolyte in said cell unit and means to pass an electrolysis current through said cell, the method which comprises circulating the said electrolyte upwardly in the electrolysis gap between said anodes and cathodes and in the interior of the hollow fingers of said anodes by the lifting effect of the anodic gases formed in the electrolysis gap, separating some of the electrolyte from the gases, recirculating a portion of the electrolyte downward in the space between the anode support wall and the anode compartment end wall, passing the anodic gas and a portion of said electrolyte upwardly near the center of said cell unit into the brine box, separating the anodic gases from the electrolyte in said brine box and recovering the anodic gases, and recirculating the electrolyte downwardly into said cell unit near at least one side of said cell unit to provide recirculation of said electrolyte from front to back of said anode compartment and from the center of the side of the anode compartment of said cell unit.

5. The method of claim 4, in which diaphragm material is fed into said brine box and from said brine box into said cell unit and recirculated through said cell unit.

6. The method of providing anolyte recirculation in a diaphragm-type electrolysis cell in which gas is evolved at the anode, which comprises operating the cell with a flooded anolyte compartment communicating with an overhead brine feed tank by at least one flooded vertical conduit leading from the top of the anolyte compartment to the top portion of said feed tank causing the anolyte to rise by the gas lift effect of the gas bubbles, and recirculating the liquid anolyte from the anolyte compartment through another flooded conduit leading from said feed tank to the anolyte compartment.

7. The method of providing anolyte recirculation within the anolyte compartment in a diaphgram-type electrolysis cell in which gas is evolved at the anode, which comprises operating the cell with a substantially flooded anolyte compartment, providing a vertical partition in said anolyte compartment extending from a short distance from the bottom of the compartment to a short distance from the top of the compartment, which partition defines a front portion of the compartment housing the anodes and a rear portion behind said vertical partition, causing the anolyte to rise in said front portion by the gas lift effect of the gas bubbles and recirculating the anolyte from the top to the bottom of the anolyte compartment through said rear portion of the compartment.

8. The method of providing anolyte recirculation in a diaphgram-type electrolysis cell in which gas is evolved at the anode, which comprises operating the cell with a flooded anolyte compartment communicating with an overhead brine tank by at least one flooded substantially vertical conduit leading from the top of the anolyte compartment to substantially the level of the electrolyte in said brine tank, causing the anolyte to rise in said conduit by the gas lift effect of the gas bubbles, and recirculating the anolyte from the bottom of said brine tank to the anolyte compartment through another flooded conduit leading from said feed tank to the anolyte compartment.

9. In electrolysis cell units for the electrolysis of alkali halide brines, having an anode compartment and a cathode compartment therein, a metal separating partition between each said cell unit and the next adjacent cell unit comprising a ferrous metal in the cathode compartment and a valve metal in the anode compartment, a metal frame around said anode and cathode compartments, a continuous, imperforate valve metal lining in the anode compartment of said frame and on said separating partition resistant to the corrosive conditions in said anode compartment, an electrolyte in said cell units, valve metal support studs projecting from said continuous, imperforate valve metal lining, anode support bars connected to said support studs, said anode support bars forming a substantially inperforate separating wall within said anode compartments separating the anodes from said valve metal separating partition and providing a space at the rear of the anodes for downward recirculation of said electrolyte, a plurality of hollow, finger-like valve metal anodes supported on said support bars, a plurality of hollow, finger-like cathode waves between said valve metal anode waves, and means to pass an electrolysis current through said cell units and the electrolyte contained therein, the method which comprises circulating the electrolyte upward along both the front and in the interior of said anode waves by the gas-lift effect of the gases formed in the electrolysis, separating a portion of the electrolyte from the gases and circulating said portion downward behind the separating wall formed by said anode support bars, separating the gases from the remaining electrolyte outside said cell units and returning the remaining electrolyte to the cell units.

10. The method of claim 9 in which a portion of the electrolyte and all the anodic gases are passed upwardly near the center of each cell unit into a brine box above the cell units, the anodic gases are separated from the electrolyte in said brine box, the anodic gases are recovered and the electrolyte recirculated downwardly into the cell units near at least one side of said cell units.

* * * * *